United States Patent [19]

Sukolics

[11] 4,114,330

[45] Sep. 19, 1978

[54] SKYLIGHT SYSTEM

[75] Inventor: Ronald D. Sukolics, Elkhart, Ind.

[73] Assignee: Kawneer Company, Inc., Niles, Mich.

[21] Appl. No.: 738,944

[22] Filed: Nov. 4, 1976

[51] Int. Cl.[2] ..... E04B 7/18

[52] U.S. Cl. ..... 52/200; 52/460; 52/461; 52/463; 52/467; 52/764; 52/772

[58] Field of Search ..... 47/17; 52/200, 460, 52/461, 463, 465, 466, 469, 467, 501, 95, 96, 11, 13, 14

[56] References Cited

U.S. PATENT DOCUMENTS

| | | | |
|---|---|---|---|
| 212,307 | 2/1879 | Friend | 52/461 |
| 412,313 | 10/1889 | Weiss | 52/200 |
| 2,175,653 | 10/1959 | Williams | 52/478 |
| 3,150,463 | 9/1964 | Nearing | 47/17 |
| 3,762,120 | 10/1973 | Janssen | 52/200 |
| 3,791,088 | 2/1974 | Sandow | 52/200 |
| 3,981,107 | 9/1976 | Schubach | 52/90 |

FOREIGN PATENT DOCUMENTS

| | | | |
|---|---|---|---|
| 2,036,158 | 12/1970 | France | 52/200 |
| 2,018,497 | 11/1970 | Fed. Rep. of Germany | 52/200 |
| 663,109 | 12/1951 | United Kingdom | 52/461 |

*Primary Examiner*—Price C. Faw, Jr.
*Assistant Examiner*—Henry Raduazo
*Attorney, Agent, or Firm*—Mason, Kolehmainen, Rathburn & Wyss

[57] ABSTRACT

A modular skylight system comprises a continuous sill for supporting a lower edge of a plurality of panel frames, each pre-assembled and having a lower edge member interlocked on the sill. Each frame includes a pair of upwardly sloping side frame members adapted to be secured and interlocked to those of adjacent members and attached at their lower ends to the lower edge member. All of the frame members include an elongated glazing pocket for receiving an edge portion of a glazing panel and they also provide gutter structure for collecting liquid from the glazing panel and for carrying the liquid down to the sill for discharge therefrom.

54 Claims, 30 Drawing Figures

FIG. 4
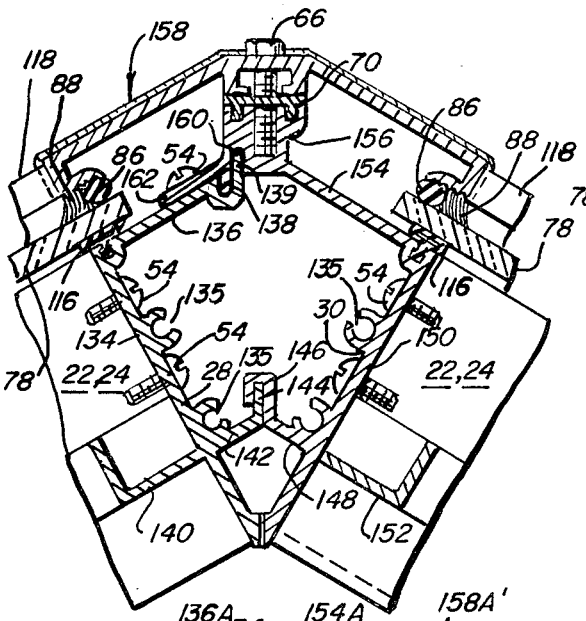
FIG. 5
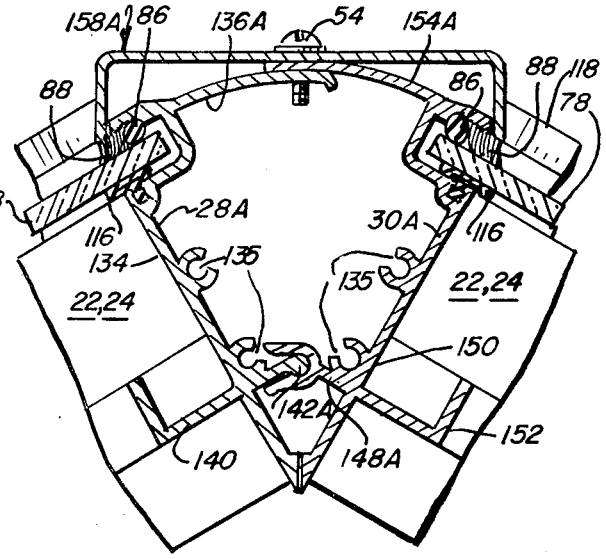
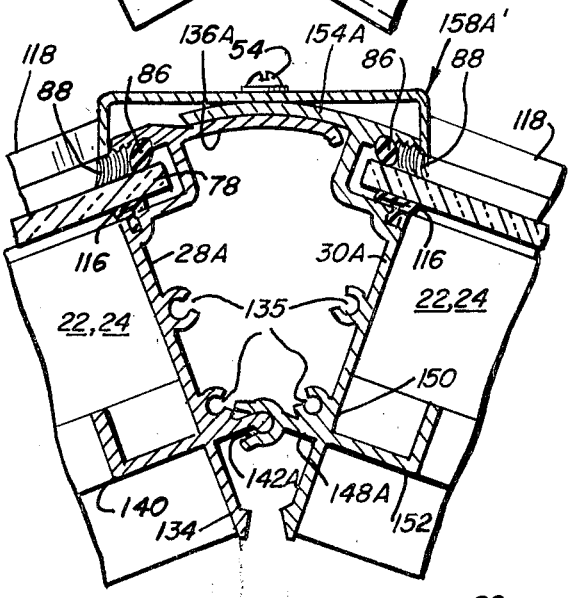
FIG. 7
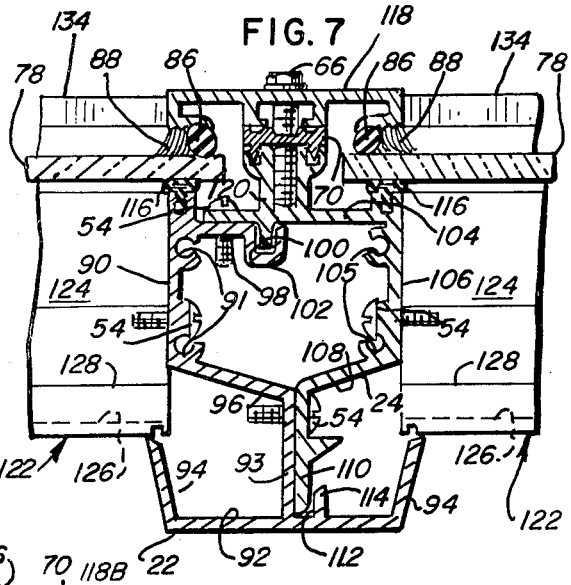
FIG. 6
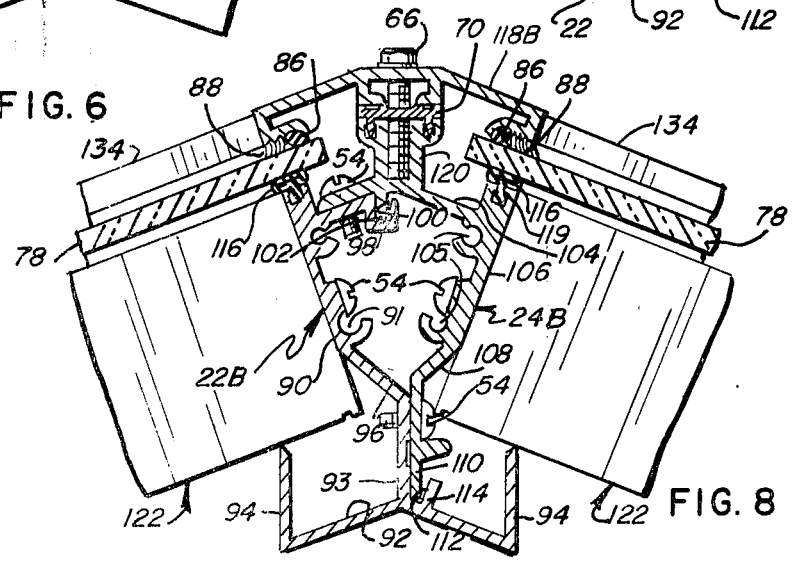
FIG. 8

FIG. 9
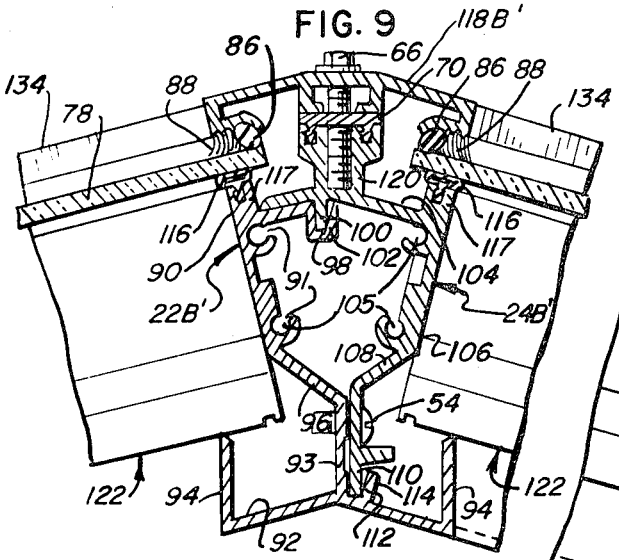
FIG. 10
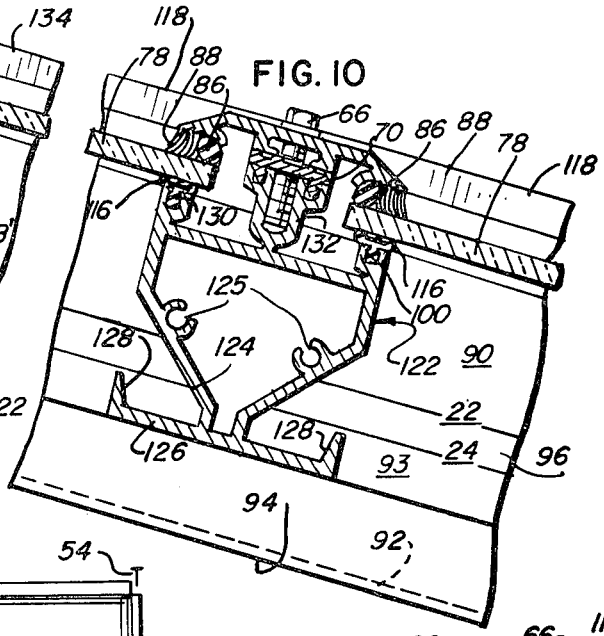
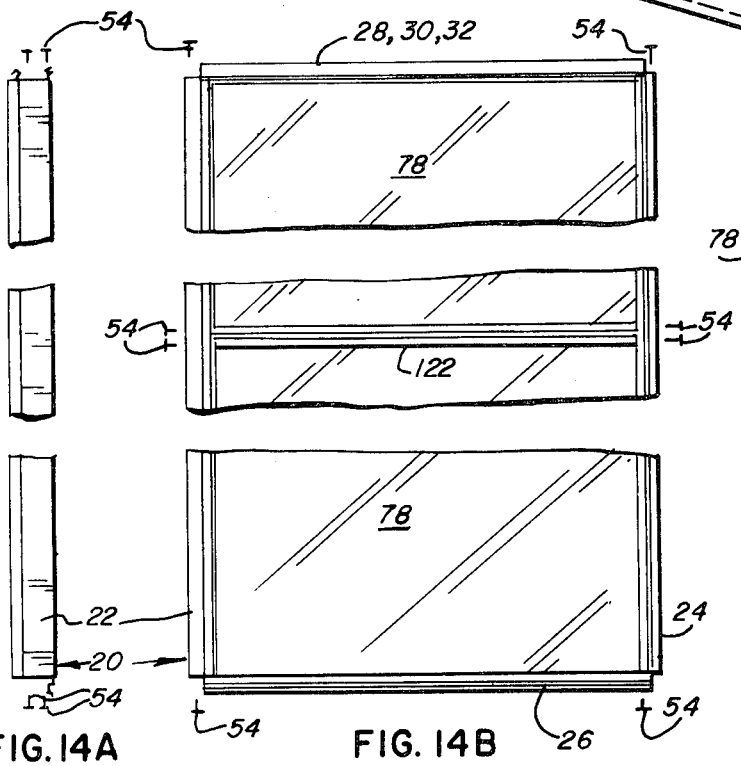
FIG. 14A FIG. 14B
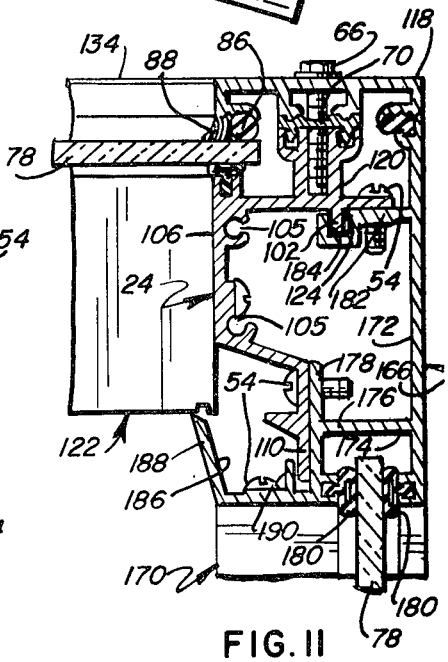
FIG. 11
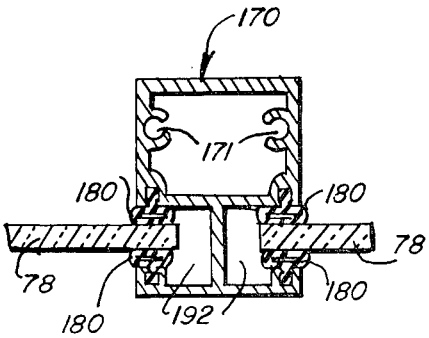
FIG. 12
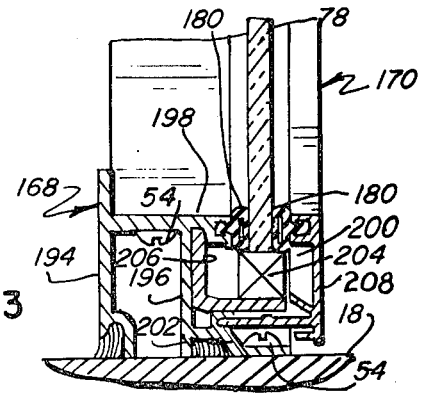
FIG. 13

SKYLIGHT SYSTEM

BACKGROUND OF THE INVENTION

1. Field of the Invention

The present invention relates to skylight systems including domes, vaults, glazed roofs and ceiling structures for buildings, factories, homes and the like.

More particularly, the invention relates to skylights which are of a unitized or modular design whereby some degree of standardization and prefabrication of the skylight panel frames is achieved.

2. Prescription of the Prior Art

Presently, most skylights are built on a custom engineered basis and these customized engineering designs require extremely high levels of skill on the part of erection personnel. In many cases, highly trained specialists are required for the erection of the skylight frames because of the relatively complex joints and cutting angles that are required. This has resulted in extremely high costs for skylight structures and for the most part, skylight construction is beyond the skill of an ordinary steel and iron worker in the trade.

It is an object of the present invention to provide a new and improved skylight system.

More particularly, it is an object of the present invention to provide a new and improved skylight system wherein extra-ordinary skill on the part of the members of a skylight erection crew is not required.

Another object of the present invention is to provide a new and improved skylight system wherein the structural members are of standardized shapes which are easier to cut, fit and assemble without requiring highly specialized training.

Still another object of the present invention is to provide a new and improved skylight system wherein a plurality of pre-assembled frames are mounted on a peripheral sill structure and are adapted for interlocking in a self-supporting manner before permanent fastenings are applied.

Yet another object of the present invention is to provide a new and improved skylight system wherein glazing of the skylight frame panel structures is simplified and improved.

Yet another object of the present invention is to provide a new and improved skylight system having a novel system of guttering for carrying away any water leakage or condensation of water on the underside of the glazing panels.

Yet another object of the present invention is to provide a new and improved skylight having an adjustable slope yet still providing for 90° end cuts on upwardly sloping frame members of the frame panels.

Yet another object of the present invention is to provide a new and improved skylight system which is especially well adapted for use in single slope type skylights, gable roof type skylights, four-sided pyramidal type skylights and six-sided conical dome type skylights.

Still another object of the present invention is to provide a new and improved skylight system wherein compound angle cuts are not required on side frame members of the panel frames.

Yet another object of the present invention is to provide a new and improved skylight system wherein the skylight may have an angularly adjustable upslope as selected without requiring special angular cuts on the framing members.

Yet another object of the invention is to provide a new and improved skylight system which includes standard or modular sized panel members arranged in an assembly or configuration designed for greatly simplified fabrication and joinery at the job site.

Another object of the invention is to provide a new and improved skylight system which is capable of meeting most of the existing codes or standards for metal curtain walls in respect to air infiltration and water leakage.

Another object of the present invention is to provide a new and improved skylight system wherein panel frames are pre-assembled into units before erection and subsequently when erected together are self-supporting, even before the final fastening elements are installed.

Still another object of the invention is to provide a new and improved skylight wherein air infiltration is minimized and wherein an excellent drainage system is provided for removing condensation from the glazing panels and water leakage from the frames.

SUMMARY OF THE INVENTION

The foregoing and other objects and advantages of the present invention are accomplished in one of the illustrated embodiments comprising a skylight having a continuous sill structure for supporting a lower edge of a plurality of pre-assembled panel frames mounted thereon. Each panel frame includes a lower edge member for interlocking attachment on the sill and a pair of upwardly sloping side frame members attached thereto. When the panel frames are of triangular configuration, the side frame members are joined together adjacent their upper ends and if the panel frames are of a rectangular configuration, a head or upper edge member is provided for interconnecting the upper ends of the upwardly sloping side frame members. Each of the members includes an elongated glazing pocket for receiving an edge portion of a glazing panel and the members include an integral gutter structure for collecting any liquid condensing on the glazing panels or water leakage from the panel frames. Each of the side frame members includes means for providing interlocking connection with a side frame member of an adjacent panel frame so that the panel frames are self-supporting upon initial erection even before the permanent fastening means have been secured in place.

BRIEF DESCRIPTION OF THE DRAWINGS

For better understanding of the invention, reference should be had to the following detailed description taken in conjunction with the drawings in which:

FIG. 4 is a fragmentary, enlarged vertical cross-sectional view taken substantially along lines 4—4 of FIG. 1B;

FIG. 5 is a vertical, cross-sectional view similar to FIG. 4, but illustrating another embodiment of the system wherein the upslope of the skylight is adjustable;

FIG. 6 is a vertical, cross-sectional view similar to FIG. 5, but showing the upper edge or head frame members of a frame panel adjusted at a different angle;

FIG. 7 is a transverse, cross-sectional view taken through a rafter of the skylight of FIG. 1B substantially along lines 7—7 thereof;

FIG. 8 is a fragmentary, transverse cross-sectional view similar to FIG. 7 taken substantially along lines 8—8 of FIG. 1C;

FIG. 9 is a transverse cross-sectional view similar to FIGS. 7 and 8, taken substantially along lines 9—9 of FIG. 1D;

FIG. 10 is a vertical, cross-sectional view taken substantially along lines 10—10 of FIG. 1B through a purlin of the skylight structure;

FIG. 11 is a transverse, cross-sectional view taken substantially along lines 11—11 through gable end rafter of the skylight structure of FIG. 1B;

FIG. 12 is a horizontal, cross-sectional view taken substantially along lines 12—12 of FIG. 1B through a vertical mullion of the skylight structure;

FIG. 13 is a vertical cross-sectional view taken substantially along lines 13—13 of FIG. 1B, illustrating a gable end sill member of the skylight structure;

FIG. 14A is an end elevational view of a prefabricated panel frame showing schematically the fasteners used in the joinery of the frame members;

FIG. 14B is a plan view of the panel frame of FIG. 14A again illustrating schematically the fasteners utilized for joining the frame members together;

DESCRIPTION OF THE PREFERRED EMBODIMENTS

Figure 1A:
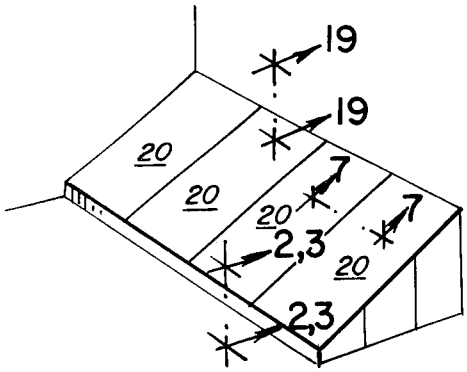
FIG. 1A is a schematic perspective illustration of a single slope type skylight constructed in accordance with the features of the present invention.
Figure 1D:
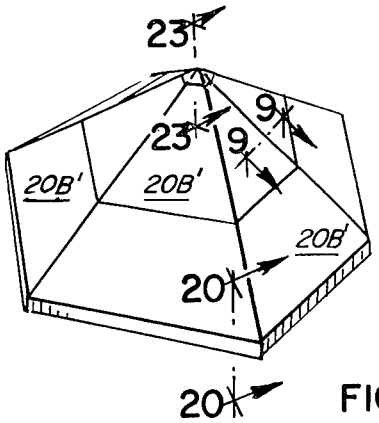
FIG. 1D is a schematic perspective view of a six-sided conical dome type skylight constructed in accordance with the features of the present invention.
Figure 1C:
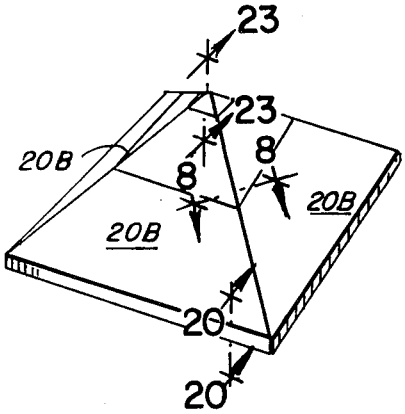
FIG. 1C is a schematic perspective view of a four-sided pyramidal type skylight constructed in accordance with the features of the present invention.
Figure 1B:
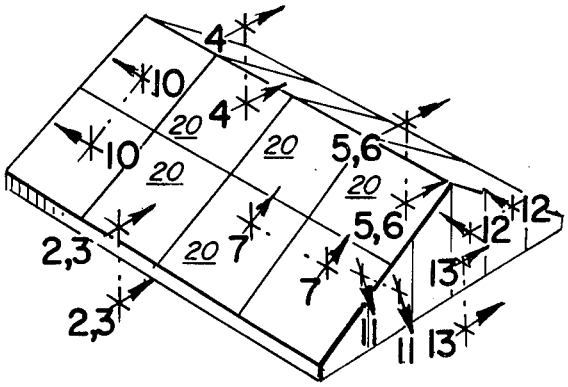
FIG. 1B is a schematic perspective view of a gable roof type skylight constructed in accordance with the features of the present invention.

Referring now more particularly to the drawings, FIGS. 1A, 1B, 1C and 1D schematically illustrate several basic skylight configurations which are constructed in accordance with the skylight system of the present invention. FIG. 1A illustrates a single-slope type skylight having a sloped roof or top wall and vertically upstanding back and/or end walls. This type of skylight may also be utilized in connection with an existing masonry or other wall structure forming a back wall or one or more end walls thereof. FIG. 1B illustrates a gable roof type skylight wherein a ridge or head is provided along the upper junction between oppositely downward sloping skylight roof panels. FIG. 1C is a four-sided, pyramid style dome skylight wherein the roof panels are of triangular shape rather than rectangular as in the previous two skylight types. FIG. 1D illustrates a hexagonal or six-sided conical dome type skylight which works in well with modern architectural styles of the present day.

The skylights of FIGS. 1A and 1B include an elongated sill or base member 10 or 10A (FIG. 2 or FIG. 3, respectively) of a generally channel shaped transverse cross-section including a floor or bottom wall structure 12 and a pair of spaced apart upstanding inside and outside walls 14 and 16, respectively, integrally formed therewith. Preferably, the sill is formed of extruded aluminum and is cut to appropriate lengths at the job site to encircle or form a perimeter around the skylight opening in a generally horizontal roof or ceiling surface of a building, as indicated by the reference numeral 18 in FIGS. 2 and 3. The sill is secured in place to the roof or structure supporting the skylight by a plurality of anchor bolts 19 provided at appropriately spaced intervals along the length of the sill sections.

Figure 19:
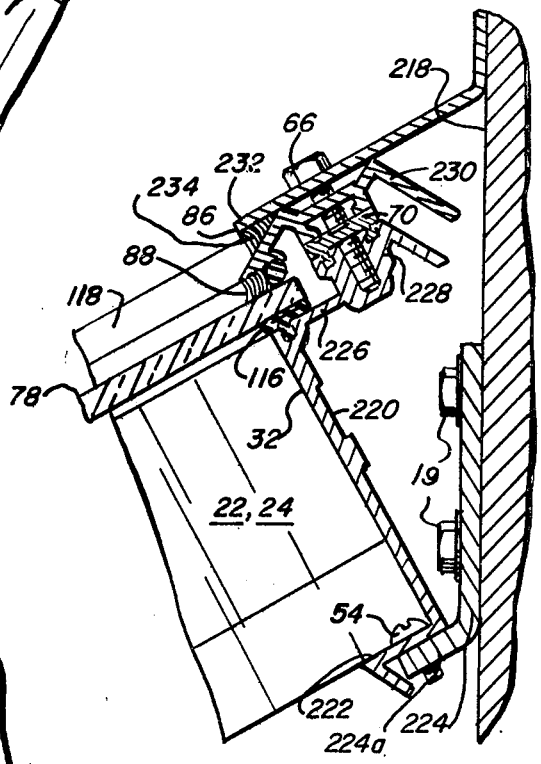
FIG. 19 is a vertical cross-sectional view taken substantially along lines 19—19 of FIG. 1A, wherein the back edge of the skylight structure abuts an existing wall structure.

In accordance with the present invention, the sill sections are adapted to support a plurality of glazing panel structures of rectangular or triangular shape and the rectangular panels are generally indicated by the reference numeral 20 in the skylights of FIGS. 1A and 1B. Each of the rectangular glazing panels includes a rectangular panel frame comprising a pair of upwardly, sloping opposite side frame members 22 and 24 (FIG. 7) adapted to interlock with an adjacent panel in side by side relation. As indicated in FIG. 7, the side frame members 22 may be designated a female member and are disposed along the right hand side of the upwardly sloping panels. The side frame members 24 may be termed as male members and these are positioned on the left hand side of the rectangular panels. Male and female side frame members are interconnected adjacent their lower ends by an elongated lower edge member 26 or 26A (FIGS. 2 and 3) and the upper ends of the side frame members are interconnected by a parallel upper edge member or head 28 or 28A, or 30 or 30A (FIGS. 4, 5 and 6). In the single sloped type skylight of FIG. 1A, the upper ends of the side frame members of the rectangular panels are interconnected by an upper edge member 32, as shown in FIG. 19.

Figure 2:
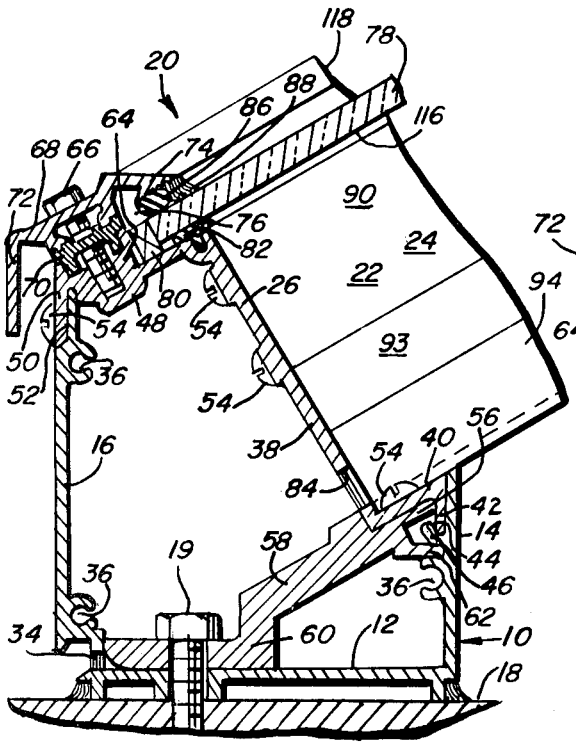
FIG. 2 is a fragmentary vertical cross-sectional view taken substantially along lines 2—2 of FIGS. 1A and 1B.
Figure 3:
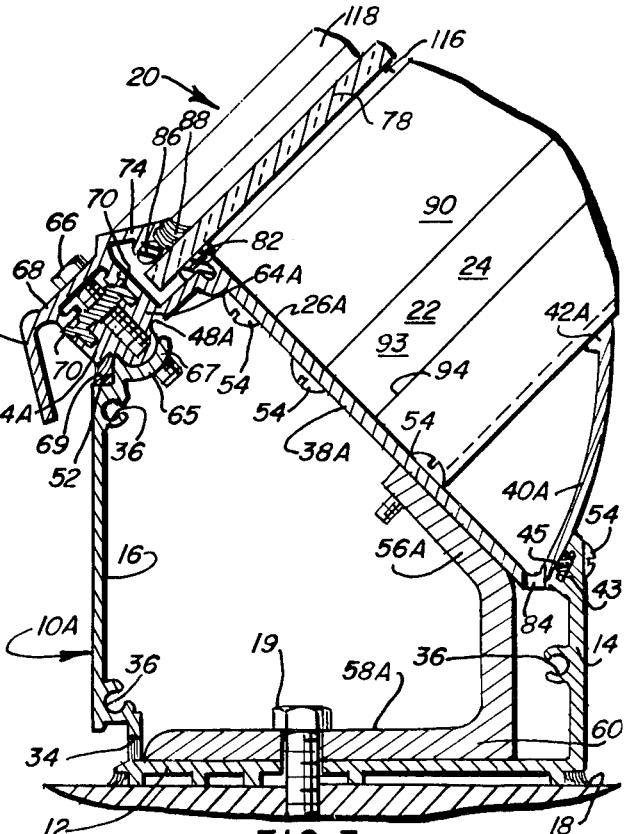
FIG. 3 is a fragmentary vertical cross-sectional view similar to FIG. 2, but illustrating an adjustable angle type skylight frame structure constructed in accordance with the features of the present invention.

Referring now to FIGS. 2 and 3, the sill members 10 and 10A are of generally channel shaped rectangular cross-section and form a trough or gutter for collecting moisture from the glazing panels 20 supported thereby. Moisture collecting in the lower portion of the sills is vented exteriorly of the skylight by a plurality of weep holes 34 provided at spaced intervals along a lower portion of the upstanding outer side wall of the sill. The sill also includes a plurality of screw splines 36 for receiving threaded shanks of self-tapping fasteners or the like used for attaching end caps or other structural members to the sills.

Referring to FIG. 2, the sill 10 is adapted to interlock with the lower edge member 26 of each rectangular panel 20 and for this purpose, the lower edge member 26 is formed with a generally Z shaped cross-section having a main wall portion 38. Along the lower edge of the main wall, there is provided an integral angle-like section 40 having a down turned tongue 42 adapted to interlock in a recess 44 formed on the inside surface of the inside sill wall 14 by a rib member 46. The upper edge of the wall 38 is provided with an integral angle-like portion 48 having a downwardly extending outer vertical flange 50 adapted to seat within a shouldered recess 52 formed on the outside surface of the outer side walls 16 of the sill. The outer flange 50 is secured in the recess 52 of the outer wall of the sill be appropriately spaced suitable portions such as self-tapping screw fasteners 54.

The lower angle portion 40 of the lower edge member 16 is secured by a screw fastener projecting into an upper tongue formed on the inner end of a thrust anchor 58 having a lower base portion 60 secured to the bottom wall 12 of the sill 10 by the anchor bolts 19. The thrust anchor 58 includes a lower tongue 62 on the inner end adapted to seat between the rib 46 and an adjacent screw spline 36 to interlock the anchor with the inside wall 14 of the sill as well as with the lower edge member 26 of the rectangular panel 20. As noted from FIG. 2, the thrust anchor 58 is of relatively thick construction in order to transmit the weight and live load from the glazing panel 20 down to the sill and anchor bolt 19 supported on the roof surface 18.

The upper angle-like portion 48 of the lower edge member 26 includes a thickened intermediate section 64 adapted to receive the threaded shank of a plurality of spaced apart fasteners 66 provided for securing a cap member 68 in place. The upper surface of the thickened portion 64 and the lower surface of the cap member 68 are separated by an insulating spacer 70 which is keyed to oppositely facing surfaces on these members. The cap member 68 includes an outer, downwardly depending drip flange 72 spaced outwardly of the tongue 50 of the lower edge member 26 so that water from the upper surface of the glazing panel is conveyed away from the sill 10. On the opposite side, the cap 68 is formed with an integral flange 74 having a generally horizontal outer surface so that water does not tend to stand or collect in this region. The thickened central portion 64 of the upper angle-like portion 48 on the lower edge member 26 and the flange 74 of the cap member 68 form a glazing recess 76 for receiving a marginal lower edge portion of a glazing panel 78 of glass or other transparent or translucent medium. The lower edge of the glazing panel is spaced from the thickened portion 64 by a plurality of spacer blocks 80 and the under side of the glazing panel rests on a resilient sealing member 82 keyed to the upper edge of the wall portion 38 so that any moisture condensing on the under surface of the glazing panel is directed downwardly along the wall 38 until it reaches a plurality of drain or weep openings 84 therein and passes into the interior of the sill 10 between the side walls 14 and 16. The flange 74 of the cap member 68 and the upper surface of the glazing panels 78 are sealed by means of suitable sealant strips 86 and caulking material 88 as shown.

From the foregoing, it will be seen that the lower edge member 26 of the glazing panels 20 closes off the open upper end portion of the sill 10 so that very little air infiltration occurs except through the weep holes 34 and 84 in the respective members. It will also be seen that the end wall 38 and lower angle-like portion 40 of the lower edge member 26 form a gutter for collecting condensation and other leakage if any, and this water is passed by the weep holes 84 down to the interior of the sill 10 for eventual discharge through the sill weep holes 34 to the outside of the skylight structure. It will also be seen that the sill and panel frame combination as described, is set up for a fixed angle of slope on the panels and that the upwardly sloping panel frame side members 22 and 24 may be conveniently square cut at their lower ends thus not requiring any angular cuts to be made for abutting joints with the lower edge member 26.

Referring to FIG. 3, a modified sill 10A and lower edge member 26A are provided to accommodate a range of adjustable angle slopes for the panels 20 rather than a fixed slope angle as in the embodiment shown in FIG. 2. In this connection, reference numerals for corresponding or identical elements will generally be the same as those elements having modified portions for accommodating the angular adjustment feature in the embodiment of FIG. 3, will be given a suitable suffix A.

The upward slope of the glazing panels 20 from the horizontal and sill 10A is adjustable within a range of angles to accommodate several architectural designs. Along the lower edge, the wall portion 38A of the lower edge member 26A is provided with an arcuate flange portion curving upwardly and terminating at a thickened edge 42A which bears against the under side of the upwardly sloping side frame members or rafters 22 and 24. The inside wall 14 of the sill is provided with a thickened edge 43 having an arcuate surface adapted to bear and seal against the bottom surface of the curved flange 40A. A suitable sealing member 45 is seated in the portion 43 so that regardless of the selected angle of slope of the panels 20, tight sealing is effected along the upper edge of the inside wall 14 with the panel edge member 26A. For each selected angle of slope, the thrust member 58A is provided with an upper tongue 56A adapted to be formed to the selected angle and this tongue is secured against the lower surface of the wall portion 38A by means of fasteners such as the screw 54. Along the upper edge of the modified lower edge member 26A, an angle-like portion 48A is provided with a thickened intermediate section 64A having an arcuate surface 65 on the lower edge adapted to seat and seal against a concave inside surface of a curved rib 67 on the upper edge of the outer wall 16 of the sill 10A. The adjustable angular engagement between these mating curved surfaces provides a pivotal support for the adjustment of the angle of slope of the glazing panels carried by the sill. A sealant strip 69 is provided within a recessed shoulder 52 to effect an air tight seal along this portion of the junction between the sill and the lower edge member 26A of the glazing panels.

From the foregoing, it will be seen that the modified combination shown in FIG. 3 provides for interlocking support between the lower edge members of the panels and the peripheral sill and in addition, also provides for selective angular adjustments in the slope of the panels relative to the sill.

Referring now to FIG. 7, an interlocked pair of male and female side frame members or rafters 22 and 24 are illustrated in transverse cross-section and the female member includes a main side wall portion 90 having a pair of screw splines 91 integrally formed on the inside surface thereof and a lower gutter forming portion having a bottom wall 92 and a pair of upwardly extending outer edge walls 94. The gutter portion is integrally connected with the side wall 90 and is connected by a vertical flange 93 and an angle-like portion 96. Along the upper portion of the side wall, a flange 98 is provided, extending inwardly at right angles thereto and formed with an upwardly opening recess 100 adjacent its outer edge. The recess 100 is adapted to interlockingly receive a depending tongue or rib 102 on the bottom of an upper flange 104 integrally joined with a main side wall portion 106 of the interconnecting male side frame member or rafter 24. The side wall 106 includes a pair of screw splines 105 formed on the inside and an angle-like lower portion 108 having a downwardly depending flange 110 provided to bear against an abutting face of the flange portion 93 of the interlocking female rafter 22. The lower end of the flange 110 extends into a recess 112 formed on the female rafter 22 between the vertical lower flange 93 and an upstanding rib 114 formed on the bottom wall 92 of the gutter.

The abutting vertical flanges 93 and 110 of the respective members 22 and 24 are permanently secured together by means of suitable fasteners 54 and similarly, the upper angle-like portion 98 of the member 22 and the abutting flange 104 of the member 24 are permanently secured by similar fasteners 54.

In accordance with the invention, the members 22 and 24 are interlocked together and self-supporting immediately after erection even before the fasteners 54 are secured in place because of the interlocking engagement between the tongue 102 and the recess 100 and the lower edge of the flange or tongue 110 in the recess 112. This positive interlock at two vertically spaced levels between the abutting female and male rafters on adjacent glazing panels permits easy erection of the framing structure which then becomes self-supporting prior to the installation of permanent fasteners and prior to the installation of the glazing panels 78 therein.

Along the upper edges, the main body portions 90 and 106 of the respective female and male rafters 22 and 24 are formed with recesses for receiving sealant strips 116 against which marginal edge portions of the glazing panels 78 are mounted. On the upper surface, the glazing panels are sealed by means of sealing strips 86 and caulking material 88 and a cap member 118 is secured in place to bear downwardly along its edges on the sealing strips and caulking. The cap is secured in place by means of cap screws 66 which extend downwardly through the insulating spacers 70 into the relatively thick upstanding portion 120 integrally formed on the upper flange 104 of the male rafter 24.

Referring now to FIGS. 7 and 10, the skylight of FIB. 1B may include a plurality of horizontal purlin members 122 spaced intermediate the sill and head members extending transversely between opposite male and female rafters 24 and 22. The purlins 122 are square cut at the ends and butt fit against outer side faces of the body portions 90 and 106 of the respective rafters 22 and 24. As shown in FIG. 7, the purlin is of a lesser depth than the rafters so that the lower edges of the purlins will be adjacent the upper edges of the side walls 94 of the gutter structure of the rafters. Referring to FIG. 10, the purlins 122 include a hollow body portion 124 having a pair of integrally formed screw splines 125 on the inner wall surface thereof. The purlins are integrally formed with a gutter structure including a bottom wall 126 and a pair of upstanding outer edge walls 128. Any water collecting in the purlin gutters is directed into the lower gutter forming sections of the assembled rafters 22 and 24 as shown in FIG. 7.

Along opposite edges of the upper portion of its main body 124, the purlins 122 are provided with a pair of recessed ribs 130 for receiving sealant strips 116 against which the lower surface of its glazing panels 78 are sealed. A thickened central portion 132 of the purlin is provided for receiving the cap screws 66 which are provided to hold in place, a cap member 134 having beveled outer corners to provide for better drainage of water flowing downwardly on the upper surface of the glazing panels 78.

Referring now to FIG. 4, the upper edge members headers 28 and 30 of the panel frames 20 are interlocked together in a self-supporting arrangement as illustrated and will remain in this position after being erected as shown until the installation of the screw fasteners 54 is completed. The header 28 includes a relatively deep side wall 134 with a flange 136 adjacent the upper edge, said flange having a recess 138 along its outer edge. A plurality of screw splines 135 are formed on the inner surface of the wall section 134 and suitable screw fasteners 54 are utilized to extend into the screw splines 91 or 105 of the rafters 22 and 24 which are square cut at the ends as shown in FIG. 4 to provide a close butt fit against the header. The header 28 includes an angle-shaped gutter segment 140 having a bottom and a side wall and the gutter segment is spaced above the gutter side walls 94 on the rafters 22 so that water collected in the header gutter structure will flow into the gutter on the rafters. The header 28 also includes a lower flange portion 142 having an upstanding rib 144 adjacent the outer end adapted to interlock within a recessed rib 146 extending along the outer edge of the flange portion 148 on the header 30. The header 30 includes a relatively deep side wall 150 similar to the side wall 134 and is provided with a plurality of screw splines 135 on the inside surface thereof. Similarly, the header 30 includes an angle shaped gutter structure 152 adapted to direct any collected liquid into the gutter structure of the rafters 22. The side walls 134 and 150 of the respective headers extend downwardly below the gutter structures thereof and abut one another as shown to provide additional stiffening for the interlocked headers 28 and 30. The header 30 also includes an upper flange portion 154 having a thickened upstanding rib section for receiving the threaded shanks of the fasteners 66 which are used to secure in a continuous header or ridge cap 158 as shown. The ridge cap has a horizontal narrow top surface and a pair of downwardly and outwardly sloping side portions with a small angle-like flange sections at the outer edges which bear against the sealing strips 86 and caulking 88 above the edges of the glazing panels 78. The ridge cap provides a continuing seal along the ridge of the gable end type skylight structure 1B from panel to panel. The upper flange 154 of the header 30 also includes a recess 160 for receiving an upwardly extending rib portion 139 on the outer edge of the flange 136 of the header 28 when the two are interlocked together as shown. The header 30 includes an outwardly and downwardly sloping flange segment 162 which bears against the upper side of the flange 136 on the header 28 and is secured thereto by cap screws 54. The flange segment 162 includes a downwardly projecting rib 164 which interlocks within the recess 138 as shown.

Accordingly, it will be seen that the headers 28 and 30 are designed for interlocking self-supporting attachment to one another and will retain themselves in an interlocked position until the permanent fasteners 54 are installed to secure the headers permanently in place. It should also be noted that the cap member 158 is continuous to extend across a plurality of side by side panel frames 20 of a skylight and the cap member thus seals off the whole ridge section of the skylight against the entry of unwanted moisture or precipitation.

Referring to FIGS. 3, 5 and 6, the modified headers 28A and 30A are utilized to accommodate different angular adjustments in the slope of the panels 20 and as illustrated in FIGS. 5 and 6, even though different slopes are utilized, the rafter members 22 and 24 may still be square cut at the ends to butt fit against the relatively deep side walls 134 and 150 of the modified headers 28A and 30A respectively.

The header 28A includes a flange 142A with a pivot bead along its outer edge to pivotally seat within a socket like recess in the outer edge of the lower flange 148A on the header 30A. This arrangement provides for pivotal interlocking attachment of the headers to accommodate a variety of different slope angles of the rafters 22 and 24 as depicted by FIGS. 5 and 6. Along the upper edge the header 28A is provided with an arcuate flange 136A designed to lay in adjustable lapping relation with an arcuate flange 154A on the header 30A. After the proper angle of slope is obtained with the headers 28A and 30A interlocked as shown in FIG. 5 or in FIG. 6, a ridge cap member 158A or 158' of suitable width is installed and held in place by fastener 54 or 66 which penetrate the arcuate flanges 136A and 154A and permanently secure the headers together.

Referring to FIGS. 14A and 14B, therein is illustrated an edge view and a plan view of a rectangular prefabricated panel frame 20 which employs a pair of side members or rafters 22 and 24 interconnected adjacent their lower ends by a lower edge member 26 and interconnected adjacent their upper ends by an upper edge member or header 28, 30 or 32. One or more intermediate purlins 122 may be provided in the frame and the elements are held together by a plurality of screw type fasteners 54 or the like which have threaded shanks extending into integral longitudinal screw splines provided in the frame members as previously described and shown. The panel frames are pre-assembled and erected and as described, are self-supporting in the erected position until the attaching screw fasteners can be installed to permanently secure the interlocking interlocked relation between side frame members of rafters of one panel 20 with rafters of adjacent panels. Similarly, interlocking of the headers 28 and 30 with those of adjacent panels sloping in an opposite direction is provided and once erected, the panels are self-supporting until permanently fastened together with screws. The lower edge members 26 and 26A are adapted to interlock with the supporting sill structures 10 and 10A, respectively, in a self-supporting fashion until the permanent fastening members 54 are installed.

Referring now to FIGS. 1B, 11–13 and 16–18, the gable end type skylight includes a gable end wall structure comprising a sloped rake rafter 166, an elongated sill structure 168 and a plurality of vertical mullions 170. The rake rafter includes a vertical outer side wall or facia portion 172 with a glazing pocket 174 formed adjacent a lower end for receiving an upper marginal edge portion of a vertically disposed glazing panel 78. The glazing pocket 174 is formed between the wall facia 172, an inwardly directed flange 176 and a vertical flange or inner side wall 178 parallel with the outer facia. The upper marginal edge portion of the vertical glazing panel extends upwardly into the glazing pocket 174 between the lower edge portion of the outer facia 172 and the inner wall 178 and suitable sealing gasket strips 180 of flexible material are provided to seal around the edges of the glazing panel.

The rake rafter 166 is adapted to interlock with a side frame or rafter 24 of the adjacent pre-fabricated panel 20, and for this purpose, the rake rafter includes an upper flange 182 inwardly directed and provided with a thickened recess portion 184 along its upper inner edge adapted to receive a downwardly extending flange projection 102 on the rafter 24. It will thus be seen that the rafter 24 of the frame panel and the rake rafter 166 of the gable end wall are mounted in interlocking relation and will remain in this relation without additional support until the permanent fasteners 54 are applied. The rake rafter is provided with a gutter segment 186 having an edge wall 188 along an inside edge for receiving liquid collected from the gutter of the purlin 122 or from the gutter of the head members 28, 30 or 32 as the case may be. When the rake rafter and the panel edge rafter 24 are assembled together as shown with the fasteners 54 in place, the lower flange 110 of the panel edge rafter extends downwardly into a recess formed between the inner wall 178 and a rib 190 extending upwardly of the gutter bottom wall on the rake rafter to provide interlocking attachment between the lower end portions of the panel edge rafter and the rake rafter.

The gable end wall also includes one or more vertical mullions 170 and these mullions have internal screw splines 171 formed on the inside surface of a tubular body portion thereof, as shown. The vertical mullions include a pair of glazing pockets 192 on opposite sides for receiving the vertically disposed marginal edge portions of a vertically disposed end wall glazing panel 78. Flexible gasket strips 180 are provided in the glazing pockets for sealing against inside and outside surfaces of the glazing panels as shown in FIG. 12.

The gable end sill structure 168 as shown in FIG. 13 includes a pair of vertical wall portions 194 and 196 integrally joined with a horizontal segment 198, the outer edge of which defines an inside edge of a glazing pocket 200 for receiving the lower marginal edge portion of a glazing panel 78. The end wall sill also includes a foot portion 202 which is secured to the roof structure 18 by suitable fasteners 54. The lower edge portion of the glazing panels is supported on glazing blocks 204 in a conventional fashion and these blocks are mounted on angle brackets 206 secured to the intermediate vertical wall 196 of the sill. The outer edge of the glazing pocket 200 is closed by a snap-in stop 208 and sealing gasket strips 180 are provided between the opposite faces of the glazing panel and the glass stop and the sill as shown in FIG. 13. The glazing panels are inserted into place and these rest on the glazing blocks 204. Thereafter, the glazing stop 208 is installed in place to provide an enclosure or outer seal for the glazing pocket of the sill.

Figure 16:
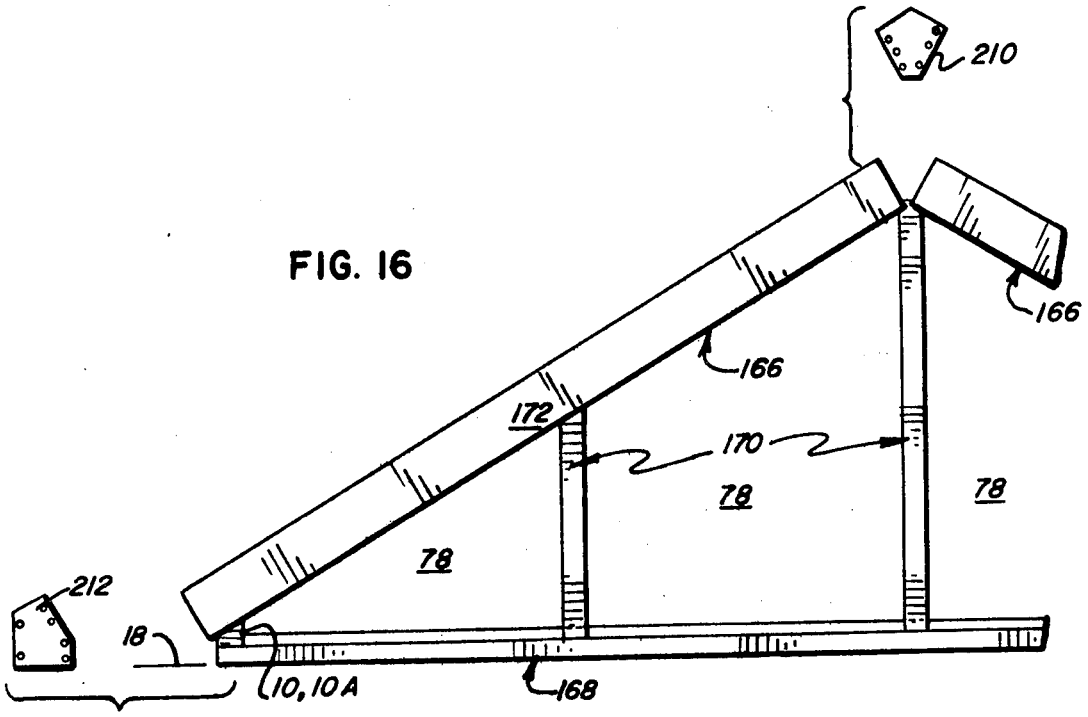
FIG. 16 is an enlarged, end elevational view of the gable roof type skylight as in FIG. 1B illustrating sill end and head end covers shown in an exploded view.
Figure 18:
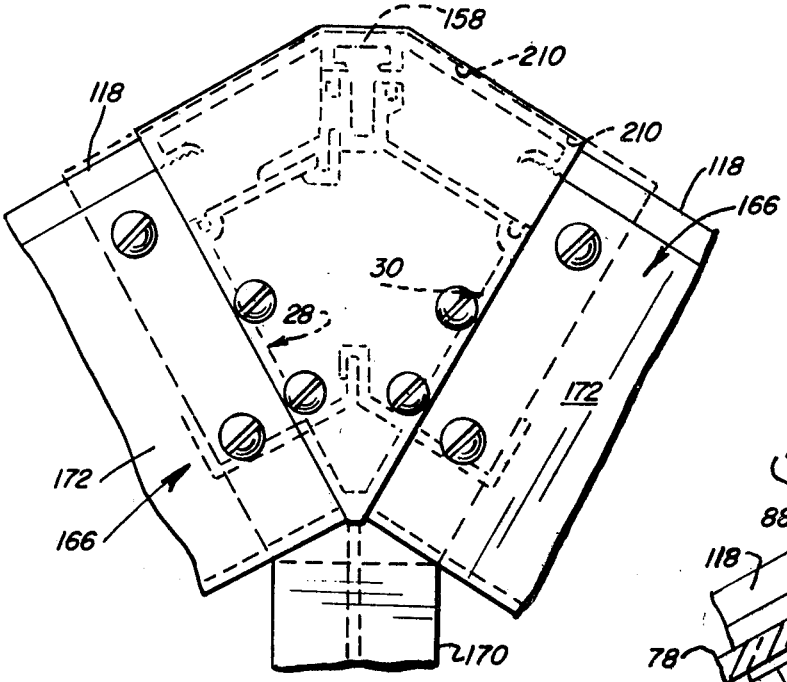
FIG. 18 is a fragmentary, end elevational view of the head or ridge end details of a gable roof type skylight of FIG. 1B.
Figure 17:
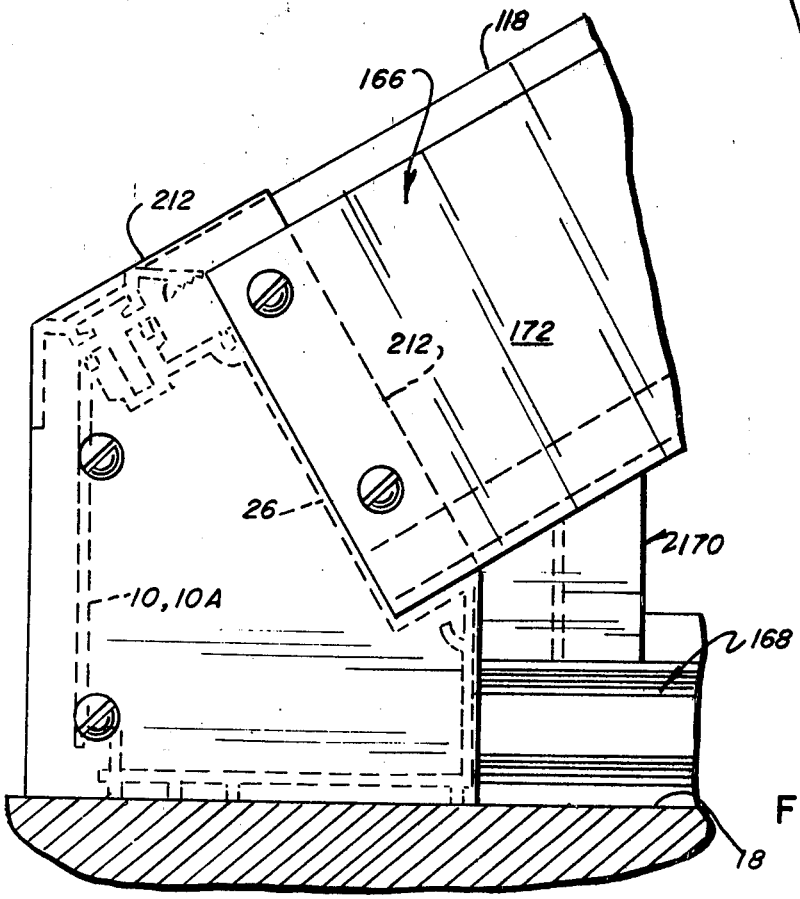
FIG. 17 is a fragmentary, end elevational view of the sill end details for skylights of the type shown in FIGS. 1A and 1B.

As illustrated in FIGS. 16, 17 and 18, the gable end wall is provided with sheet metal and caps 210 at the head or ridge of the gable and a sheet material end cap 212 at the sill or lower edge of the gable. These end caps are fastened into place with screw fasteners directed into the internal screw splines 135 on the head members and the screw splines 36 on the sill 10 or 10A as shown. The resultant gable end type skylight as shown in FIG. 1B is neatly trimmed and tightly sealed to admit the maximum amount of light through the skylight opening in the roof of a building.

Figure 15A:
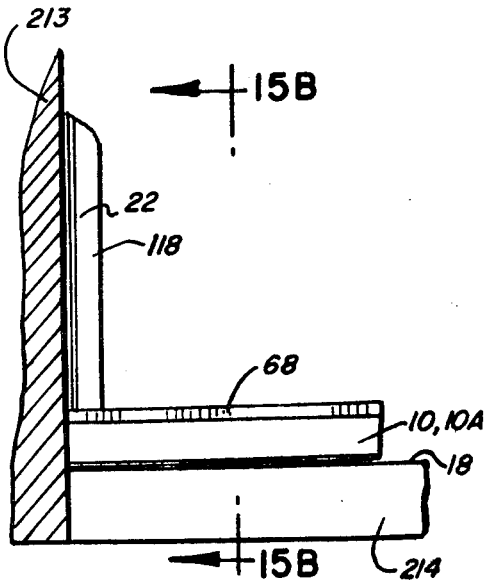
FIG. 15A is a fragmentary elevational view illustrating a single slope type skylight as in FIG. 1A, wherein one end of the structure abutts a masonry wall.
Figure 15B:
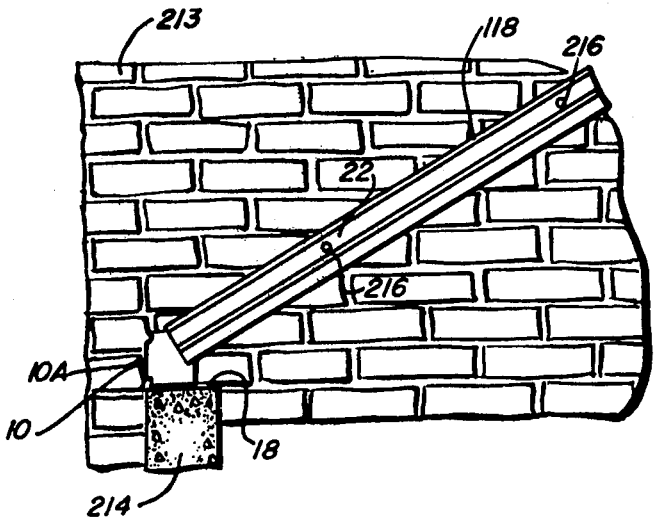
FIG. 15B is a fragmentary elevational view looking in the direction of arrows 15B of FIG. 15A.

Referring now to FIGS. 15A and 15B, therein is illustrated an end portion of a skylight of the type shown in FIGS. 1A and 1B wherein one end wall of the skylight structure is formed by an upstanding structural building wall such as a masonry wall 213. The skylight structure sill is supported on a concrete wall or beam 214 around the skylight opening. As illustrated, a panel rafter 22 is secured in place against the maxonry wall 213 by means of anchor bolts 216 and a sill 10 or 10A is similarly secured to the concrete beam 214.

Referring now to FIG. 19, therein is illustrated a fragmentary sectional view of a skylight of the type shown in FIG. 1A wherein the back side of the skylight structure abutts an upstanding structural building wall indicated by the reference numeral 218. The panel frames 20 in this type of skylight employ an upper edge member or header 32 with a profile as shown including a wall portion 220 having a flange 222 along the lower edge. The lower edges of the square cut rafters 22 and 24 of the frames 20 are seated on the upper surface of the lower flange 222 and the header 32 is supported from the masonry or other wall structure 218 by a plurality of relatively heavy anchors 224 provided at spaced intervals and secured into the wall by anchor bolts 19. The anchor 224 has an outwardly sloping short flange **224*a* at the lower end which provides support for the panel frames and the anchor is secured to the flange 222 of the headers 32 by suitable fasteners 54. At the upper ends, the header 32 includes an upper flange 226 having a thickened central section 228 for receiving threaded shanks of cap screws 66 used for securing a cap member 230 in place on the insulating spacer strip 70 as in the previous embodiment. The cap screws 66 extend downwardly through a sheet metal flashing member 232 which includes a vertical portion secured and weather sealed against the wall structure 218 and a downwardly sloping portion overlying the cap member 230 and secured thereto by the cap screws 66. Along the lower edge, the flashing member 232 and the cap member 230 are sealed by means of a caulking strip 234**.

Referring now to FIGS. 1C, 1D, 8, 9 and 20–25, the pyramidal and hexagonal type skylights employ triangular shaped pre-fabricated skylight panels indicated by the reference numerals 20B and 20B'. The hexagonal skylight shown in FIG. 1D, employs triangular shaped panels 20B' having a different angle between the convergent side rafters indicated as 22B' and 24B' than that of the pyramid shaped skylight of FIG. 1C and the rafters 22B' and 24B'. The rafter configuration and general construction of the two skylights is generally similar except that the cross-section of the rafters in the respective skylights is slightly different as illustrated in FIGS. 8 and 9 to accommodate the different convergent angular relationship between the opposite rafters. Referring to FIGS. 7, 8 and 9, the female rafters 22, 22B and 22B' are all of generally similar cross-section and similar or identical reference numerals are used for corresponding or identical components. The major difference in the cross-sectional profiles of these rafters is the degree of angular deviation between the main side walls 90 and 106 relative to a vertical plane. In the rafters 22B and 24B shown in FIG. 8, this angle has a slope which is designed to permit the purlins 122 to have square cut ends as shown with only a simple angle cut being required to provide a close butt fit of the purlin end against the outer surface of the main body portions 90 and 106 of the rafters. This arrangement reduces the probability of error in requiring compound angle cuts of the purlins and other transverse connecting members. Similarly, the rafters 24, 24B and 24B' are of substantially the same cross-section or profile except that the angle of the outer face of the main body wall 106 of the rafters is sloped at different angles from the vertical to again permit a square butt end cut of the purlins 122 with a simple angle rather than a compound angle cut. It should be noted that the angle of upward slope of the faces 90 and 106 of the rafters 22B and 24B, respectively, of the pyramidal shaped skylight of FIG. 1C, is somewhat smaller than the relatively steeper slope of the faces 90 and 106 of the respective rafters 22B and 24B' of the hexagonally shaped dome skylight of FIG. 1B. In either case, the angle of slope of the body sides of the respective rafters is designed to permit square cut ends on the purlins 122 so that only a simple angle cut is required rather than a compound angle cut as in many other prior art domes.

Figure 20:
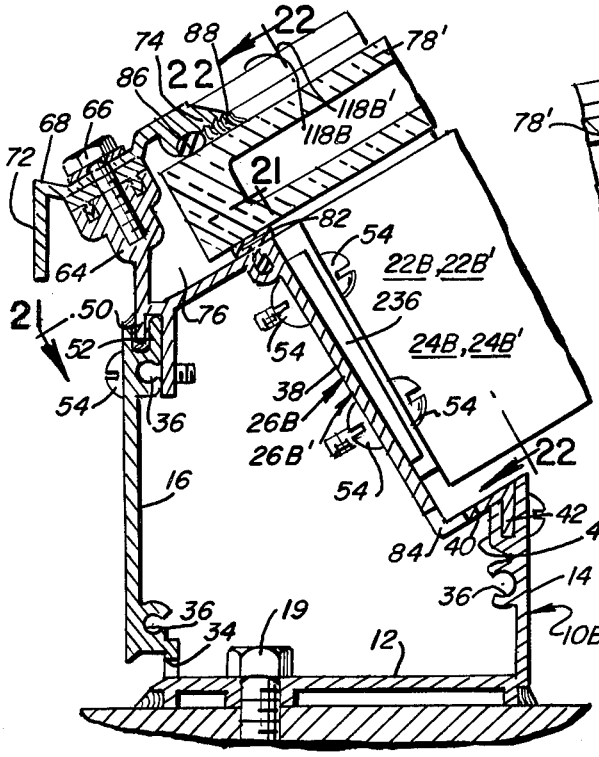
FIG. 20 is a vertical cross-sectional view illustrating the sill end rafter construction and interconnection taken substantially along lines 20—20 of FIGS. 1C and 1D.
Figure 22:
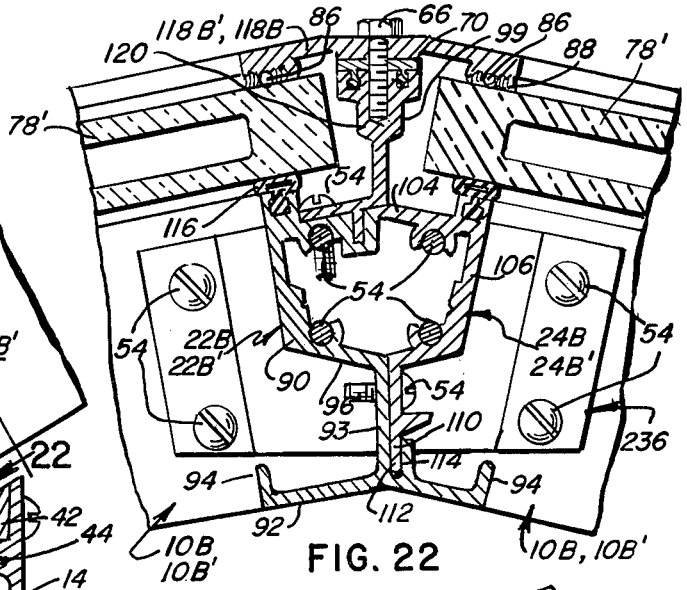
FIG. 22 is a fragmentary cross-sectional view taken substantially along lines 22—22 of FIG. 20.
Figure 21:
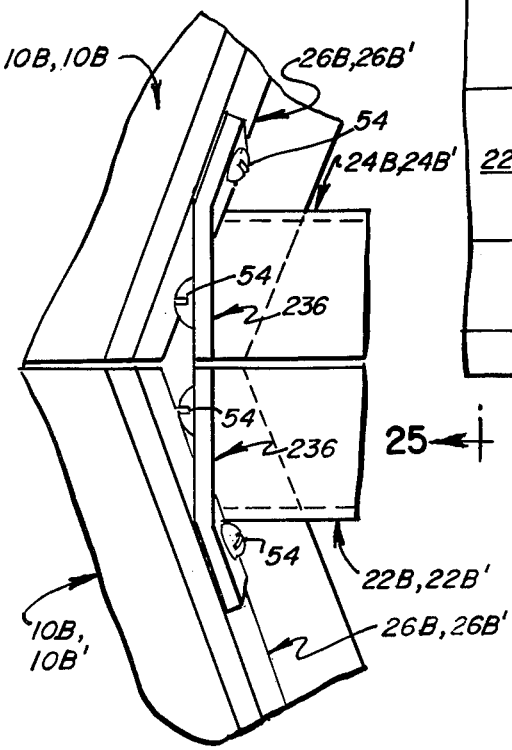
FIG. 21 is a fragmentary cross-sectional view taken substantially along lines 21—21 of FIG. 20.
Figure 25:
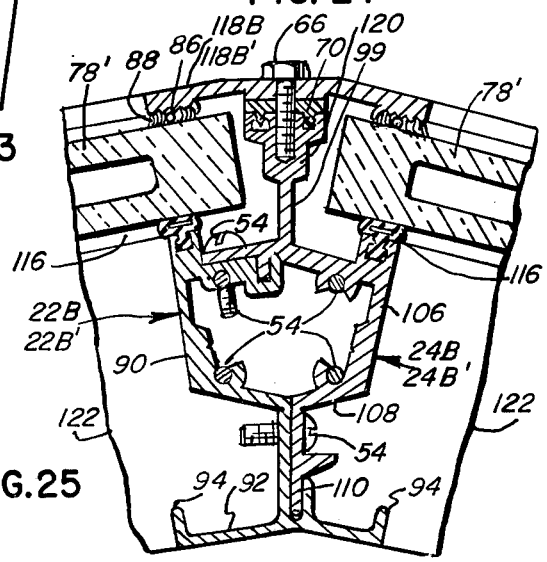
FIG. 25 is a fragmentary cross-sectional view taken substantially along lines 25—25 of FIG. 23.

It should be noted that the sectional views illustrated in FIGS. 7, 8 and 9 show a single pane type of glazing panel 78 rather than double glazed panel 78' as shown in the sectional views of FIGS. 20, 22 and 25. Referring to FIGS. 22 and 25, the rafters 22B and 22B' and the rafters 24B and 24B' for double glazed panels 78' have modified cross-sections as shown to include a short vertical flange section 99 for accommodating the increased thickness. In all other respects, the rafters are of substantially identical cross-section with respect to the rafter cross-sections illustrated in FIGS. 8 and 9.

Referring now to FIGS. 20–25, the skylights of FIGS. 1C and 1D employ a modified sill member 10B including sill segments cut to length with angular cut ends as shown. With the four sided skylight of FIG. 1C the angle of cut is 45° and with the skylight of FIG. 1D the sill is cut at a 60° angle. The sill segments are attached to the floor and from a continuous perimeter around the skylight opening. The sill 10B is similar in cross-section to the sill 10 and employs a floor or bottom wall 12, an upstanding inside wall 14 and an outside wall 16 extending upwardly to a greater height and thus the sill is of a channel shaped cross-section as shown. Internal screw splines 36 are provided and weep holes 34 are located at suitable intervals along the sill for drainage of any liquid collected. The modified triangular panels 20B and 20B' of the respective skylights employ the modified interlocking side members or rafters as previously described and in addition, a modified lower edge member 26B or 26B' of the cross-sectional shape shown used to interconnect the lower ends of the rafters and is mounted and interlocked with the sills 10B or 10B' as shown. In order that the rafters 22B, 22B', 24B and 24B' may be square cut at the ends rather than requiring end cuts at an acute angle or a compound angle cut at each lower corner of the pre-fabricated triangular frames 20B or 20B' there is provided an angular strip connector 236 having one angular segment or flange adapted to bear against the body 38 of the lower edge member 26B or 26B' and secured thereto by a pair of fasteners 54. The angular strip connectors also include another segment which is adapted to butt fit against the square cut end of the rafters 22B, 22B', 24B and 24B' and secured thereto by fasteners 54 which extend into longitudinal screw splines 91 provided in the respective rafters as shown in FIG. 22. The angular strip connectors 236 thus permit square cut ends on the lower ends of the rafters and eliminate the need for acute or compound angular cuts which are relatively complicated and difficult.

Figure 23:
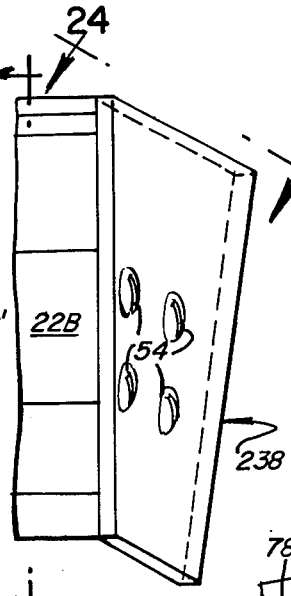
FIG. 23 is a fragmentary vertical cross-sectional view taken substantially along lines 23—23 of FIG. 1D.
Figure 24:
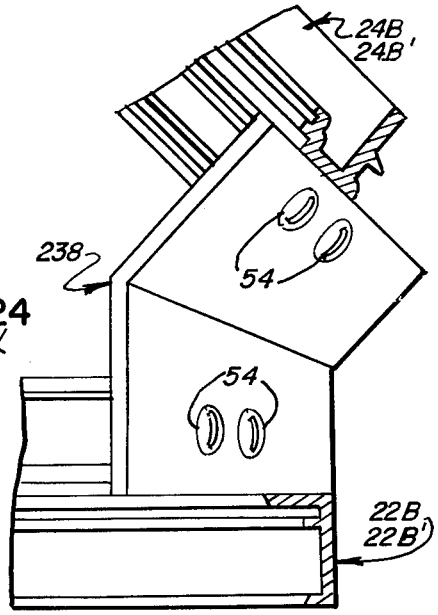
FIG. 24 is a fragmentary top plan view looking in the direction of the arrows 24—24 of FIG. 23.

Referring to FIGS. 23, 24 and 25, at the upper ends the rafters 22B and 24B of the panels 20B and the rafters 22B' and 24B' in the panels 20B' are interconnected by means of angular clips 238 having segments arranged to abutt against square cut upper ends of the respective rafters. The slips are secured to the rafters by fasteners 54 which extend into the internal screw splines 91 and 105 of the respective rafters. As with the previous rectangular panels 20, the triangular shaped panels 20B and 20B' are pre-fabricated before erection by interconnecting the lower edge members 26B or 26B' with a pair of rafters 22B and 24B, or 22B' and 24B', respectively, which rafters are interconnected to the lower edge members by means of the angular connector strips 236 at the lower ends and by means of clip angles 238 at the upper ends. With this arrangement, the rafters may be square cut at the ends without requiring acute angle cuts or compound angle cuts and as previously described, if horizontal purlins 122 are provided, the purlins may be cut with simple angle cuts rather than compound angle cut as many prior art skylight structures now require.

The triangular shaped panels 20B and 20B' are adapted to interlock with adjacent panels by means of the same type of interlocking attachment between the female rafters or side frame elements 22B and 24B or 22B' and 24B' as previously described for the rectangular panels 20. The panels are self-supporting once placed in an erected position and subsequently fasteners 54 are installed to permanently secure the panel frames in place ready for installation of glazing panels 78 or 78'. The pyramidal or hexagonal shaped domes or skylights as described, employ a modified cap strip 118B or 118B' dependent upon the angular arrangement as illustrated in FIGS. 8 or 9 and these cap strips seal off the joint between adjacent glazing panels similar to the caps 118.

From the foregoing it will be seen that the skylight system of the present invention offers a great many advantages as described and provides a system which may be erected and installed by artisans of ordinary skill rather than requiring extra-ordinary skilled artisans as are commonly required by prior art structures.

Although the present invention has been described with reference to several illustrative embodiments thereof, it should be understood that numerous other modifications and embodiments can be devised by those skilled in the art that will fall within the spirit and scope of the principles of this invention.

What is claimed as new and desired to be secured by Letters Patent of the United States is:

1. A skylight comprising:

a sill for supporting a lower edge of at least one panel frame mounted thereon, and at least one pre-assembled panel frame including a lower edge member for interlocking attachment on said sill and a pair of upwardly sloping side frame members secured to said lower edge member, said members, each including an elongated glazing pocket for receiving an edge portion of a glazing panel, and at least one of said sloping members including gutter means for collecting liquid from said glazing panel carried thereby, said gutter means arranged to discharge into gutter means formed by said lower edge member, said sill including a pair of upstanding walls and a bottom wall forming sill gutter means for receiving liquid collected in said gutter means of said members of said panel frame, said side frame members each including means for interlocking connection with a side frame member of an adjacent panel frame.

2. The skylight of claim 1 wherein said side walls include means for interlocking engagement with said lower edge member of said panel frame.

3. The skylight of claim 1 wherein said lower edge member includes a baffle wall for substantially closing off said sill between said upstanding side walls above said bottom wall.

4. The skylight of claim 2 including means for pivotally interlocking said sill and said lower edge member of said panel frame to permit angular adjustment of the upward slope thereof.

5. The skylight of claim 4 wherein said pivotal interlocking means interconnects a portion of said lower edge member of said panel frame and one of said side walls of said sill.

6. The skylight of claim 5 including means for sealing between the other of said side walls of said sill and an opposite portion of said lower edge member of said panel frame.

7. The skylight of claim 1 wherein said panel frame includes an upper edge member interconnecting upper ends of said side frame members, said upper edge member including an elongated glazing pocket for receiving an edge portion of said glazing panel and gutter means for collecting liquid.

8. The skylight of claim 7 wherein said upper edge member includes means for interlocking connection with an upper edge member of an opposite panel frame, whereby interlocked upper edge members form a ridge of said skylight.

9. The skylight of claim 8 including means for pivotally interconnecting said interlocking upper edge members of a pair of panel frames thereby permitting angular adjustment of the upward slope of said panel frames.

10. The skylight of claim 8 including a pair of said frames arranged opposite of one another and sloping in opposite directions, said upper edge member of each panel frame interlocked together along a ridge of said skylight.

11. The skylight of claim 10 wherein said interlocking means of said upper edge members of said panel frames and interlocking engagement between said lower edge members and said sill retains said panel frames in upwardly sloped position without requiring additional fasteners.

12. The skylight of claim 10 including a detachable cap member mounted over said interlocked upper edge members for covering the interlocking connection therebetween.

13. The skylight of claim 1 including in combination a thrust anchor for transmitting load from said side frame members of said panel frame to a building structure on which said sill is mounted.

14. The skylight combination of claim 13 including means for securing a lower edge portion of said panel frame to said thrust anchor for preventing uplift of said panel frame.

15. The skylight combination of claim 14 including means for securing a lower edge portion of said panel frame to said sill.

16. The skylight of claim 1 including in combination, a thrust anchor structurally interconnecting said panel frame and a building structure on which said sill is mounted transmitting a load from the panel frame to the building structure.

17. The skylight of claim 16 wherein said thrust anchor is interconnected between said lower edge member of said panel frame and a bottom wall of said sill.

18. The skylight of claim 10 including a detachable cap member attached over a pair of interlocked side frame members of adjacent panel frames.

19. The skylight of claim 1 including:

a plurality of said panel frames mounted on said sill, at least one pair of said pre-assembled panel frames in interlocking adjacent side by side attachment on said sill, said sill including lower gutter means for receiving liquid from said gutter means of said lower edge members, said side frame members each including means for interlocking connection with a side frame member of an adjacent panel frame on said sill.

20. The skylight of claim 19 wherein at least one of said panel frames includes an upper edge member interconnecting the upper ends of said side frame members, said upper edge member including an elongated glazing pocket for receiving an edge portion of said glazing panel and gutter means for collecting liquid.

21. The skylight of claim 20 wherein said gutter means of said upper edge member is arranged to discharge collected liquid into said gutter means of said side frame member.

22. The skylight of claim 20 wherein said upper edge members include means for interlocking connection with an upper edge member of an oppositely sloping panel frame.

23. The skylight of claim 22 wherein said interlocking means of said upper edge members includes pivotal interconnecting means between said upper edge members permitting variable slopes of the side frame members thereof.

24. The skylight of claim 22 including a detachable cap member attached over said interlocking upper edge members.

25. The skylight of claim 19 including a detachable cap member attached over a pair of interlocked side frame members of said adjacent side by side panel frames.

26. The skylight of claim 19 including a continuous detachable cap member secured to extend across the lower edge members of said adjacent side by side panel frames.

27. The skylight of claim 26 wherein said cap member includes a cover portion overlying a junction between a portion of said sill and a lower edge member of said panel frames.

28. The skylight of claim 27 wherein said cap member includes an outer drip portion spaced outwardly and downwardly of said junction.

29. A skylight structure comprising:

an elongated sill for supporting a lower edge portion of an upwardly sloping skylight, said sill including a bottom wall and a pair of spaced apart upstanding side walls integral therewith forming a gutter, and an upwardly sloping skylight including a frame having a lower edge member and a pair of side members and at least one glazing plane supported by said frame, said lower edge member secured to said sill and including a baffle wall extending between said side walls substantially closing off the space between said side walls above said bottom wall, said lower edge member including gutter means between said side walls for collecting moisture from said skylight frame for discharge to said gutter of said sill.

30. The skylight structure of claim 29 including means for pivotally interconnecting said lower edge member and one of said side walls of said sill for permitting angular adjustment of the slope of said skylight, and means for sealing between the other of said side walls of said side and said lower edge member permitting angular adjustment therebetween.

31. The skylight structure of claim 29 wherein said gutter means is adjacent a lower portion of said lower edge member for collecting liquid from said glazing panel, and weep means in said lower edge member for discharging said liquid into said gutter of said sill between said side walls.

32. The skylight structure of claim 31 wherein said sill includes weep means adjacent a lower portion of an outside one of said side walls for discharging said liquid received from said gutter thereof.

33. The skylight structure of claim 32 wherein said weep means in said lower edge member and said weep means in said sill are offset from one another.

34. The skylight structure of claim 29 wherein said wall of said lower edge member includes a pair of wall segments at right angles to each other forming said gutter means along the lower portion of said lower edge members, and at least one rafter in said frame having a square cut lower end supported in said gutter means and sloping upwardly therefrom.

35. The skylight structure of claim 34 wherein said lower edge member and said rafter of said frame include a glazing recess adjacent an upper edge portion thereof for receiving a marginal edge portion of said glazing panel.

36. A skylight comprising:

a sloped wall portion having a preassembled frame and at least one glazing panel supported from said frame, a vertical wall along one side of said sloped wall portion for supporting the same, said preassembled frame including a lower edge member and a pair of side frame members sloping upwardly thereof, said vertical wall including an end frame supporting at least one glazing panel therefrom and interconnected with said sloped wall portion, said end frame including at least one vertical member and a sloped rafter member.

at least one of said rafter and side frame members including gutter means for receiving liquid from said sloped wall portion, an elongated sill forming a sill gutter and supportingly interconnected with a lower edge member of said preassembled frame of said sloping wall portion, said gutter means positioned to discharge at its lower end into said sill gutter, and an end cap closing off an end of said sill adjacent said rafter of said end wall.

37. The skylight of claim 36 including means for interlocking interconnection of said rafter member and a side frame member adjacent thereto.

38. The skylight of claim 36 wherein said gutter means comprises an integral gutter portion of said rafter member on an inside portion thereof.

39.The skylight of claim 38 wherein said rafter member includes a glazing pocket for a vertically disposed glazing panel positioned outside of said gutter portion.

40. The skylight of claim 36 wherein said sill has a first portion attached to and supporting said lower edge member of said preassembled frame and a second portion intersecting said first portion supporting said vertical member of said end frame below said rafter member.

41. The skylight of claim 40 wherein said vertical member includes a pair of screw splines and opposite ends thereof are butted against said second sill portion and said rafter member.

42. The skylight of claim 41 including elongated screw fasteners extending through said second sill portion and said rafter member into said screw splines for securing said vertical member in place.

43. The skylight of claim 40 wherein said rafter member, vertical member and second sill portion include a glazing recess for receiving a marginal edge portion of a vertical glazing panel.

44. The skylight of claim 36 wherein said sill includes a plurality of longitudinal screw splines, and said end cap is secured in place by a plurality of screw fasteners extending through said end cap into said screw splines.

45. A skylight comprising:

a sill for supporting a lower edge of at least one panel frame mounted thereon, at least one preassembled panel frame including a lower edge member for interlocking attachment on said sill and a pair of upwardly sloping non-parallel side frame members secured adjacent their lower ends to said lower edge member, a strip member butt fitted against and secured to the upper ends of said non-parallel side frame members, said lower edge member and at least one side frame member of said prefabricated frames being formed with gutter means for collecting liquid from glazing panels carried thereby, said sill including a gutter formed between a pair of upstanding side walls interlocked with said lower edge members, said gutter disposed below said gutter means of said lower edge members of said panel frames, and said side frame members including means for interlocking connection with a side frame member in a panel frame mounted adjacent thereto.

46. The skylight of claim 45 wherein said strip member includes a pair of segments angularly disposed to each other to closely butt fit against upper ends faces of said non-parallel side frame member, said end faces cut on a plane normal to a longitudinal axis of said side frame members.

47. The skylight of claim 46 wherein said non-parallel side frame members are formed with longitudinal screw splines and said strip member is secured in butt fitting relation against a squared end of said frame member with at least one screw fastener extending into said screw spline.

48. The skylight of claim 45 wherein said gutter means of said side frame member is positioned to discharge at its lower end into said gutter means of said lower edge member.

49. The skylight of claim 45 including a purlin member parallel of said lower edge member interconnected at opposite ends to said side frame members intermediate their length, said side frame members including a side face abutting the ends of said purlin member cut at right angles to a top surface thereof.

50. The skylight of claim 49 wherein said purlins include gutter means discharging at said opposite ends into gutter means of said side frame member.

51. The skylight of claim 49 wherein said purlin member includes at least one longitudinal screw spline and said side frame members are secured against said abutting end of said purlin member with at least one screw fastener extended into said screw spline.

52. The skylight of claim 45 wherein said side face of said side frame members are on a plane perpendicular to a plane along a top surface of said purlin member sloping upwardly parallel of a glazing panel carried by said panel frame.

53. The skylight of claim 45 including a second strip member having a pair of angularly disposed segments, one of said segments in end abutting relation with a square cut lower end of side frame member and the other of said segments abutting a surface of said lower edge member.

54. The skylight of claim 53 wherein said side frame members include longitudinal screw splines and said second strip member is secured thereto with screw fasteners extending into said screw spline.

* * * * *